United States Patent [19]

Stahl

[11] 3,976,038

[45] Aug. 24, 1976

[54] RECIPROCATING STRATIFIED CHARGE INTERNAL COMBUSTION ENGINE AND MIXTURE FORMATION PROCESS

[76] Inventor: Günter Stahl, Gartenstrasse 17, 7910 Neu-Ulm, Germany

[22] Filed: Mar. 22, 1973

[21] Appl. No.: 343,696

[30] Foreign Application Priority Data

| | | |
|---|---|---|
| Mar. 24, 1972 | Germany | 2214400 |
| May 5, 1972 | Germany | 2222029 |
| Dec. 7, 1972 | Germany | 2259888 |

[52] U.S. Cl. ..... 123/32 SP; 123/32 ST

[51] Int. Cl.[2] ..... F02B 19/10; F02B 19/16

[58] Field of Search ..... 123/32 ST, 32 SP, 32 CY, 123/191 S

[56] References Cited

UNITED STATES PATENTS

| | | | |
|---|---|---|---|
| 820,285 | 5/1906 | Cross | 123/32 SP |
| 2,011,992 | 8/1935 | Aseltine | 123/32 SP |
| 2,690,741 | 10/1954 | Broderson | 123/32 ST |
| 3,166,051 | 1/1965 | Hallberg | 123/32 SP |
| 3,255,739 | 6/1966 | von Seggern et al. | 123/32 ST |

FOREIGN PATENTS OR APPLICATIONS

| | | | |
|---|---|---|---|
| 1,063,424 | 10/1956 | Germany | 123/32 SP |

*Primary Examiner*—Charles J. Myhre
*Assistant Examiner*—Ronald B. Cox
*Attorney, Agent, or Firm*—Brumbaugh, Graves, Donohue & Raymond

[57] ABSTRACT

In a two or four cycle reciprocating internal combustion engine, an intake section is defined in the combustion chamber wherein a stratified charge of a rich fuel-air mixture is established in close proximity to the intake valve and the spark plug. An exhaust section also is defined within the combustion chamber and is connected with the intake section through a passage of restricted cross section. Fuel is injected into the intake manifold of the engine through a low pressure fuel injector during an optimum period of the crankshaft rotation. The operable excess air ratio may be adjusted by varying the position of the intake section with relation to the cylinder axis.

14 Claims, 12 Drawing Figures

Valve lift curves and fuel injection rate for four stroke cycle

Valve/port timing and injection rate

RECIPROCATING STRATIFIED CHARGE INTERNAL COMBUSTION ENGINE AND MIXTURE FORMATION PROCESS

BACKGROUND OF THE INVENTION

1. Field of the Invention

This invention relates in general to a spark ignition reciprocating internal combustion engine having an intake section defined within each combustion chamber, wherein the intake section facilitates formation of a stratified charge of a rich fuel-air mixture near the spark plug. The invention further relates to internal combustion engines, of either the four-stroke cycle or two-stroke cycle type, which operate on liquid or gaseous fuels, preferably hydro-carbons of various compositions.

2. The Prior Art

Over more than three decades, internal combustion engine configurations have been known which utilize charge stratification in the combustion chamber in connection with spark ignition, to enable engine operation using excess air. It is well known that such internal combustion engine operation has several advantages over the usual spark ignition engines which operate with a homogeneous air-fuel mixture. These advantages include, for example:

1. Lower combustion process temperatures, especially at partial load, as the fuel-air mixture may be leaner than the chemically correct mixture. As a result, the heat loss to the combustion chamber walls may be reduced.
2. Increased thermal and chemical efficiency as the thermodynamic process using excess air more closely approximates the pure air cycle and, furthermore, perfect combustion with excess air is possible.
3. Less or no dissociation of combustion products as compared to a conventional spark ignition engine, due to the lower combustion temperatures which result from the excess air supply.
4. Lower engine pumping losses, since little or no throttling of the intake air is required and, accordingly, the engine operation may be controlled chiefly through mixture adjustment.
5. The charge stratification, i.e., keeping the rich mixture close to the spark plug, makes it possible for the engine to operate as a multi-fuel engine, without knocking even when low octane fuels are used.
6. Considerably reduced emission of pollutants in the exhaust gases, especially carbon monoxide and nitrogen oxides, resulting from the lower combustion temperatures and for the more perfect combustion resulting from use of excess air.

Some known charge-stratified internal combustion engines are the following: (I) Broderson's Stratified Charge Engine, USA, 1952; (II) Texaco Combustion Process by E. M. Barber, USA, 1949; (III) J. Wizky's Stratified Charge Engine, USA, 1949, and (IV) Hesselmann's Oil Engine, Sweden, 1934. To achieve a charge stratification, i.e., a richer fuel-air mixture in the vicinity of the spark plug, the four combustion systems mentioned above have the following common characteristics: (a) high-pressure fuel injection into the combustion chamber at the end of the compression stroke, shortly prior to the initiation of the spark ignition, and (b) transfer of the rich fuel-air mixture to the spark plug by a rotating air charge.

One inherent disadvantage of these characteristics, especially with the combustion processes utilized in engines I, II, and IV, stems from the necessity to control the injection and ignition timing according to the engine load and speed. Moreover, the injection and ignition timing must be matched under any operating conditions. The only combustion process producing a richer mixture in the center of the combustion chamber, at the spark plug, independent of engine load and speed, is utilized in engine III. Of the combustion processes employed in the several engines I–IV, therefore, only that of engine III allows the injection and ignition timing to be selected independently of engine load and speed, but even then only within certain limits.

These and other shortcomings of the prior art are overcome by the present invention.

SUMMARY OF THE INVENTION

It is accordingly an object of the invention to provide a reciprocating internal combustion engine having an intake section defined in the combustion chamber which provides for charge stratification, i.e., mixture enrichment in the region of the spark plug, independent of engine load and speed.

It is another object of the invention to utilize low-pressure fuel injection or low-pressure fuel introduction into the intake manifold or the intake duct of the engine, thus eliminating the requirement of a complicated high-pressure injection system.

A further object of the invention is to permit the time period for the preparation of the combustion mixture to be extended, without endangering the charge stratification.

The foregoing and other objects are attained, in accordance with the invention, by the provision of a novel combustion chamber geometry and mixture formation process. More specifically, the combustion chamber associated with each cyclinder is divided into two sections, the "intake section" and the "exhaust section," which are connected by a passage of restricted cross section. The intake section encompasses the intake valve and the spark plug, so that, upon induction of the fuel-air mixture into the combustion chamber, an enriched mixture is established within the intake section. The fuel is introduced at low pressure into the intake manifold immediately upstream of the intake valve, and induction of the fuel-air mixture into the combustion chamber is carried out during an optimum period of the appropriate piston stroke, depending upon whether the engine operates on a four-stroke cycle or a two-stroke cycle. As another feature of the invention, the richness of the mixture, i.e., the amount of excess air provided, in the intake section can be controlled by varying the spacing between the intake section and the cylinder axis. Thus, the intake section may be located directly over the cylinder, or partly in overlying relation to the cylinder, or entirely beyond the projected cross section of the cylinder, depending on the amount of excess air desired in the intake section.

BRIEF DESCRIPTION OF THE DRAWINGS

For a better understanding of the invention, reference may be made to the following description of exemplary embodiments thereof, taken in conjunction with the accompanying drawings, in which.

DESCRIPTION OF EXEMPLARY EMBODIMENTS

Figure 1:
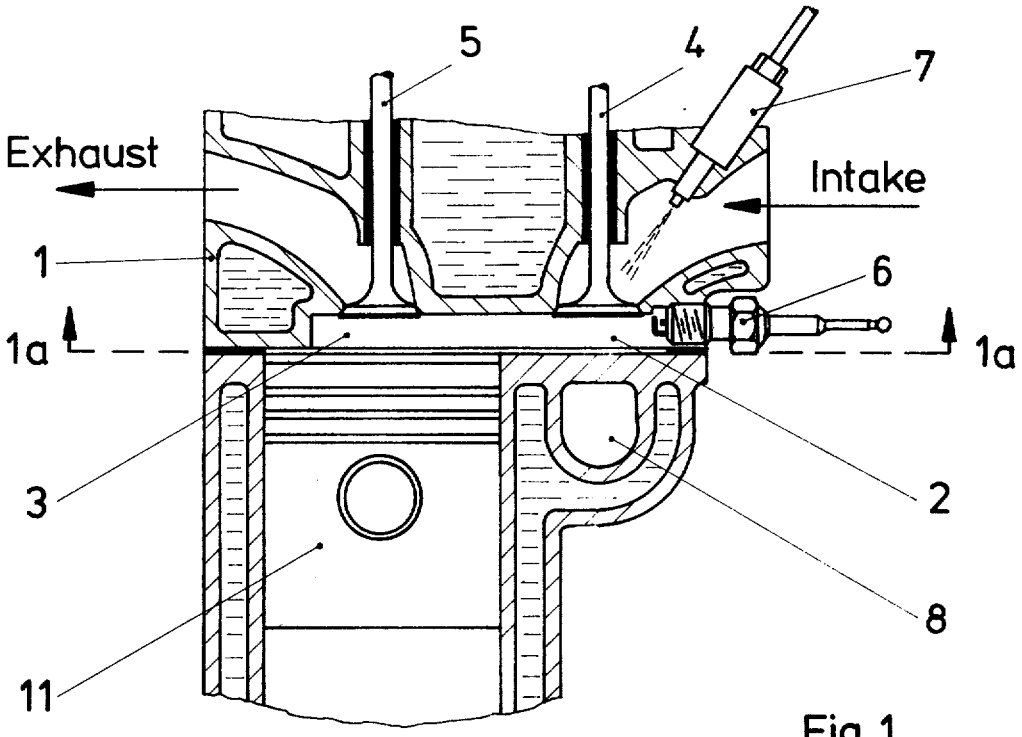
FIG. 1 is a sectional view of one embodiment of the invention showing a portion of a reciprocating four-cycle internal combustion engine having a combustion chamber constructed in accordance with the invention.
Figure 1A:
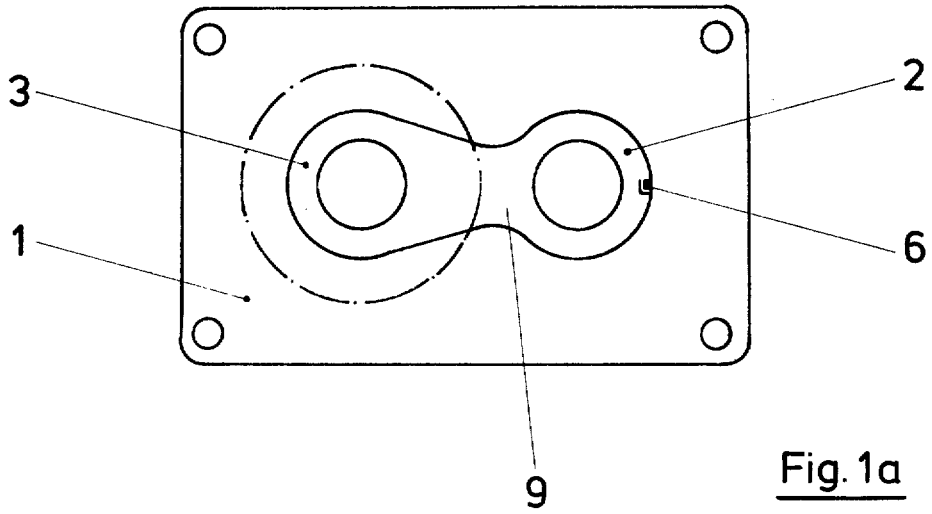
FIG. 1*a* is a diagrammatic bottom view of FIG. 1 taken along line 1*a*—1*a*.

In the four cycle engine of FIGS. 1 and 1*a*, the combustion chamber is subdivided into two sections, one adjoining the intake valve 4 and the other adjoining the exhaust valve 5. These sections are referred to herein as the intake section 2 and the exhaust section 3. They are interconnected by a channel 9 of restricted cross section. To prevent throttling losses, on the one hand, the cross section of channel 9 should be as large as possible, and, on the other hand, it should be narrow enough to facilitate the stratification of the charge. The spark plug 6 is located in the intake section 2, in close proximity to intake valve 4. The fuel-air mixture enrichment at the spark plug 6 is achieved in this combustion chamber by inducing fuel into the intake manifold or duct upstream of the intake valve 4. The fuel injection is timed in such a way that it commences in the second half of the intake stroke and terminates approximately at the end of the same stroke.

Basically the charge stratification and combustion process proceeds in the following manner: The fuel is injected through fuel induction device 7, under low pressure into the intake duct in close proximity to intake valve 4. The charge stratification, i.e., a rich fuel-air mixture in the intake section 2, is therefore possible only when the fuel injection commences in the second half of the intake stroke and is terminated prior to or at the end of the intake stroke. As the xhaust section 3 receives its charge through the intake section 2, it is filled with a lean fuel-air mixture or air only during this period of fuel intake.

If a specific lean mixture composition in the exhaust section 3 is desired, the fuel induction interval may be extended beyond the termination of the suction stroke. In this way, a certain amount of fuel is stored in front of the intake valve to produce the desired lean mixture in the exhaust section 3 during the next suction stroke.

Figure 2:
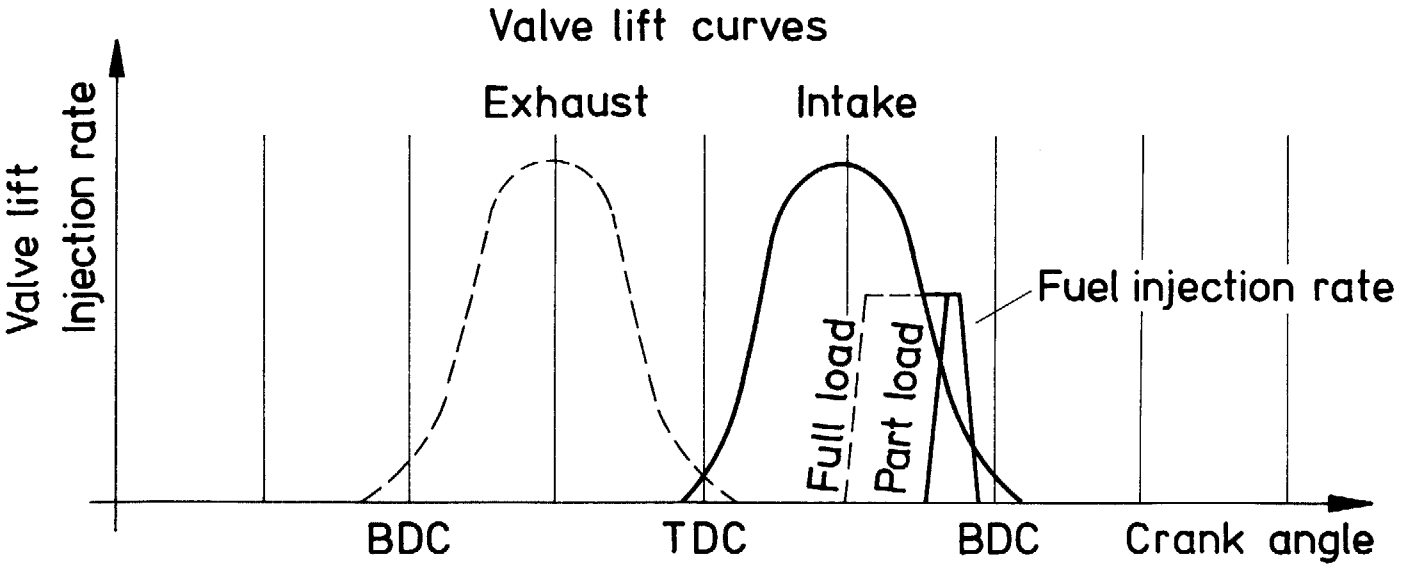
FIG. 2 is a graphic illustration of the valve lift curves and fuel injection rate and time according to the invention for a four-cycle internal combustion engine.

The start of fuel induction during the suction stroke depends on the engine load. With increasing load the induction has to start earlier, assuming a constant fuel quantity per unit of time is supplied. This is illustrated in FIG. 2, where the timing and rate of fuel injection for "Full load" and "Part load" conditions are superimposed on a graph of valve lift versus crankshaft angle. According to the invention, the fuel-air mixture preparation takes place almost entirely in the intake section 2 during the full duration of the compression sroke. The mixture preparation may be further improved by preheating the bottom of the intake section 2 of the combustion chamber by, for example, flowing the emitted exhaust gas through a duct 8.

The above-described configuration of the combustion chamber according to the invention substantially reduces the exchange of charge between the intake section 2 and the exhaust section 3 during the compression stroke, thus maintaining the charge stratification required. Thus, charge stratification according to this invention enables the engine to operate on average lean fuel-air mixtures, i.e., with the air charge being in excess of the chemically correct one.

Compared to the previously known charge stratification systems, the invention affords the following advantages: (1) low-pressure fuel injection into the intake duct; (2) relatively long fuel-air mixture preparation interval extending over the entire compression stroke; and (3) rich ignitable fuel-air mixture stratified near the spark plug, independent of engine load and speed.

Recently published test results carried out on a simple four-stroke cycle test engine of similar configuration to that shown in FIGS. 1 and 1*a* have proved the feasibility of engine operation with extremely high excess air rates. A faultless operation up to an excess air ratio of 2.4 (i.e., 140% excess air, based on the chemically correct air-fuel ratio) were achievable. It is well known that engines with such high excess air ratios may be operated in nearly the entire load range by mixture control. The latest tests performed on stratified charge engines have proved that they have a considerably reduced exhaust emission of noxious pollutants, particularly of carbon monoxide and nitrogen oxides in comparison to engines without charge stratification. However, these investigations also have indicated that such extreme excess air ratios as those achieved in the test engine shown in FIGS. 1 and 1*a* are unnecessary. Even a moderate increase above the maximum air-fuel ratios, of 1.25 to 1.35, which may be achieved in conventional spark ignition engines results in a satisfactory reduction of undesirable exhaust emissions.

In view of the above air-fuel ratio values, the four-stroke cycle stratified charge engine according to FIGS. 1 and 1*a* may therefore be modified for operation with maximum air rates only moderately exceeding those possible in conventional spark ignition engines which operate on homogeneous air-fuel mixtures. According to the invention, this modification is achieved by shifting the intake section 2 of the combustion chamber in closer to the engine cylinder axis as the desired maximum excess air rates are decreased. However, as the intake section 2 is shifted closer to the engine cylinder axis, the intake valve is moved closer to the exhaust section 3 and it becomes easier for an exchange of charge to occur between the intake section 2 and exhaust section 3, since the cross section of the connecting channel 9 increases. How far the intake section 2 is to be shifted towards the cylinder axis is dependent only on the maximum excess air ratio desired for operation of the engine. The scope of the invention is, of course, intended to include all possible intermediate locations of the intake section 2 between the two extremities, that is, entirely beside the cylinder as in FIGS. 1 and 1*a* and exactly above it as in FIGS. 3 and 3*a*. It is noteworthy that throttling losses during the intake stroke will also decrease with decreasing spacing of the intake section 2 from the cylinder axis.

Figure 3:
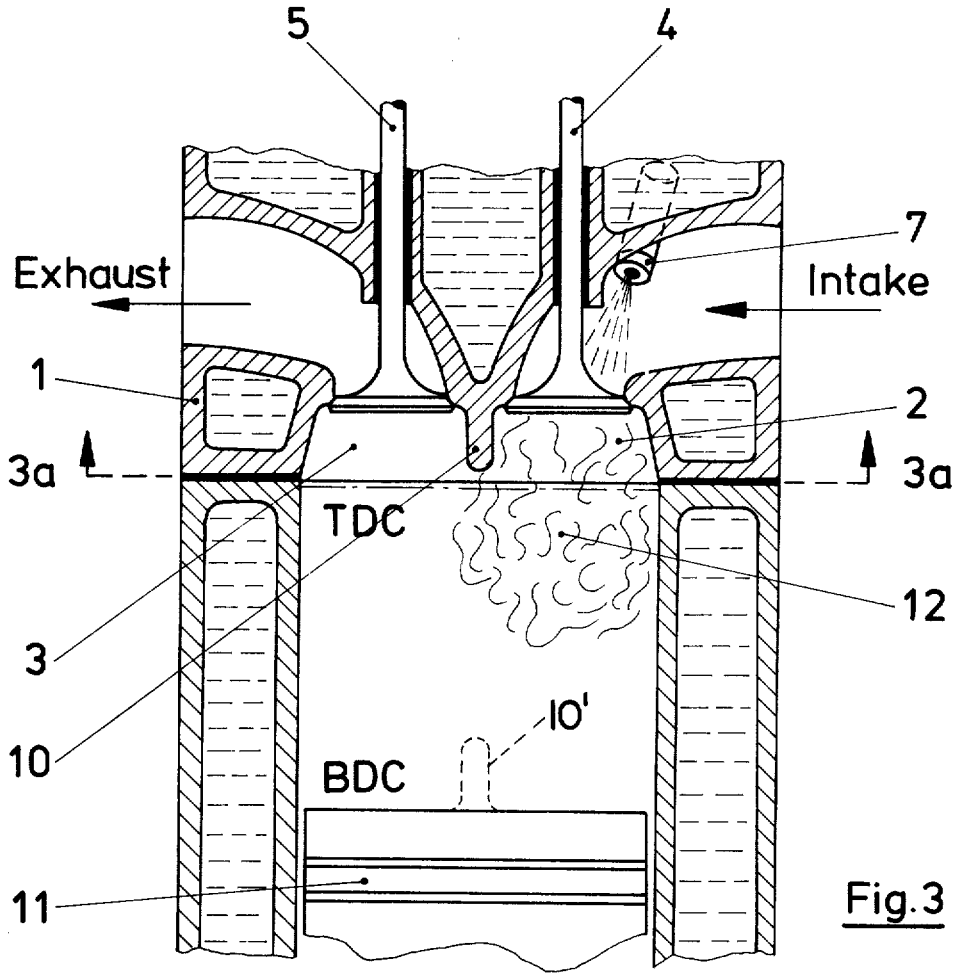
FIG. 3 is a sectional view of another embodiment of the invention, as incorporated into a four-cycle engine.
Figure 3A:
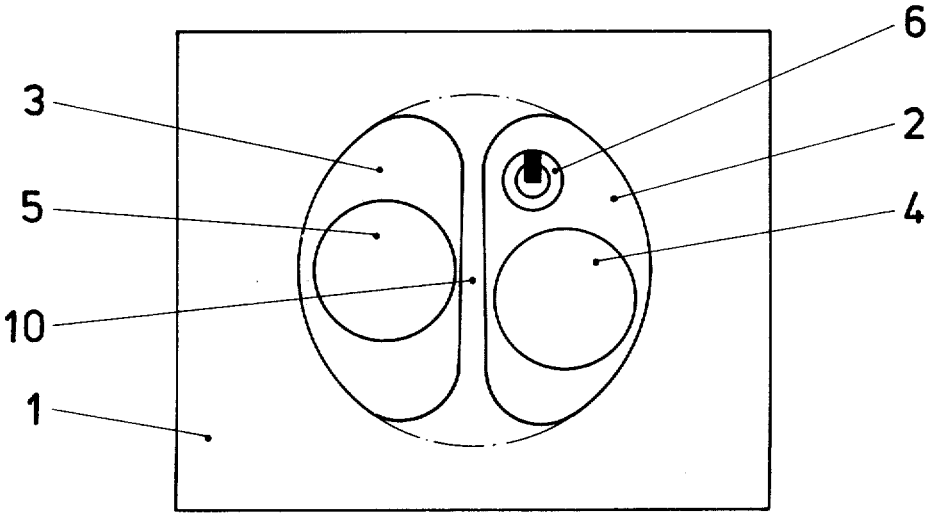
FIG. 3*a* is a diagrammatic bottom view of FIG. 3 taken along line 3*a*—3*a*.

FIGS. 3 and 3*a* show an embodiment of the invention wherein the intake section 2, with intake valve 4 and spark plug 6, are located entirely in overlying relation to the cylinder in side by side relationship to the exhaust section 3. The separation of the intake section 2 and exhaust section 3 is formed merely by a transversely extending partition rib 10 in the cylinder head 1 and by the crown of piston 11 as it approaches the top dead center portion during the compression stroke. That is to say, the passage of restricted cross section is formed between the lower edge of rib 10 and the crown of piston 11.

Alternatively, a rib 10' can be located on the piston crown so as to protrude into the combustion chamber when the piston approaches top dead center, thereby forming the restricted passage with the facing wall of the combustion chamber.

The fuel inducted during the second half of the suction stroke through the injection nozzle 7 and the intake valve 4 thus forms a richer fuel-air mixture in the cylinder section located below the intake section 2 than in the portion of the cylinder below the exhaust section 3. Mixture cloud 12 in FIG. 3 illustrates the rich charge stratification at the end of the suction stroke. To keep the lean and rich parts of the charge separated until the piston reaches the top dead center position of the compression stroke, the relative mixing movement of the fuel-air mixture between the intake and exhaust sections, 2 and 3, of the cylinder volume should be reduced as much as possible. This can be accomplished by keeping the rotation and turbulence of the air flow through the intake duct to a minimum.

It will be appreciated, therefore, that the charge stratifying technique of the invention allows a moderate increase of the excess air ratio over values presently achievable in conventional spark ignition engines. Moreover, this is achieved merely though shifting the intake section towards the cylinder axis. The closer the intake section is moved towards the axis the lower are the maximum available excess air ratios as well as the throttling losses during the intake stroke.

Figure 4:
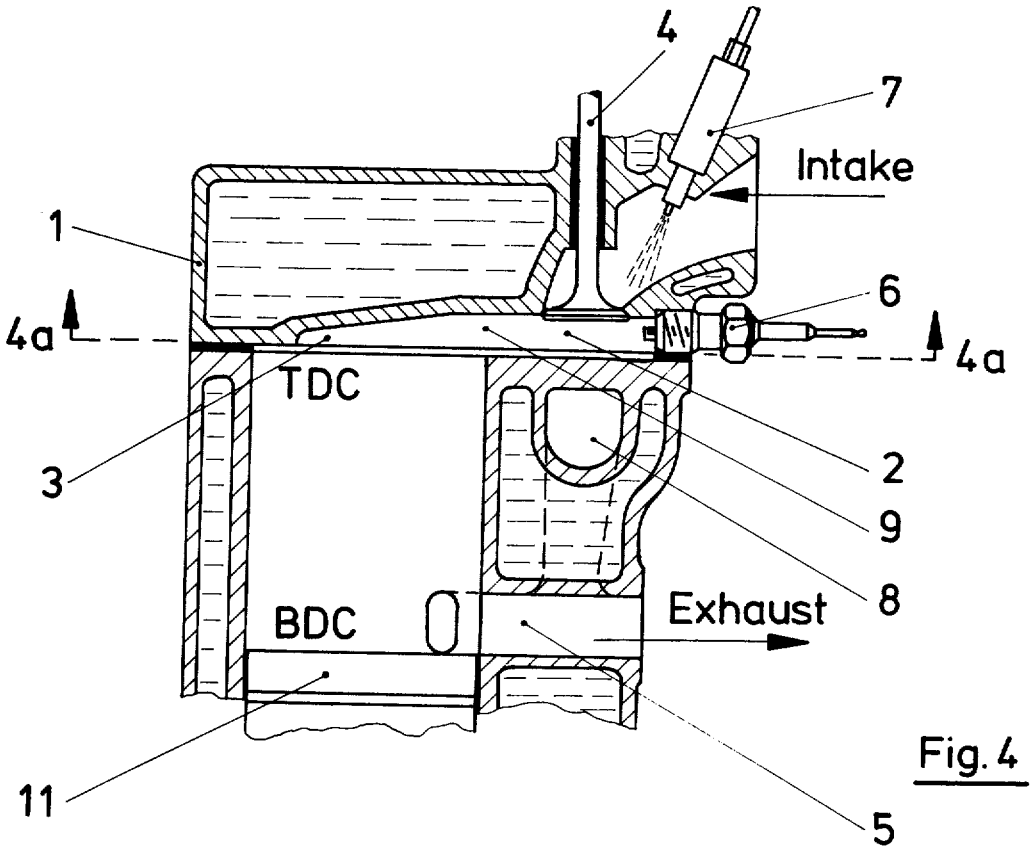
FIG. 4 is a sectional view of a portion of a reciprocating two-cycle internal combustion engine illustrating a further embodiment of the invention.
Figure 4A:
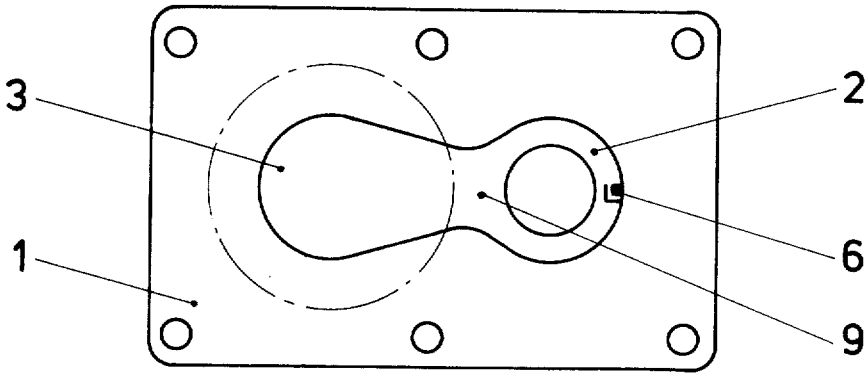
FIG. 4*a* is a diagrammatic bottom view of FIG. 4 taken along line 4*a*—4*a*.

As another feature of the invention, it is also possible to apply the foregoing principle of mixture formation and charge stratification to a two-cycle reciprocating engine which operates with through-flow scavenging and a scavenging pump. FIG. 4 illustrates the combustion chamber geometry, according to the invention, for a two-cycle reciprocating internal combustion engine. The spark plug 6 and intake valve 4 are in the intake section 2. FIG. 4*a* is a diagram of the combustion chamber showing the shapes of intake section 2, exhaust section 3 and passage 9 of the combustion chamber. Exhaust ports 5 are opened by movement of the piston 11 when the crank angle is close to bottom dead center. The fuel injector 7 is housed in the intake duct of the cylinder head 1. From the exhaust ports 5, a duct 8 branches off for preheating the bottom of intake section 2, should this be required.

Figure 5:
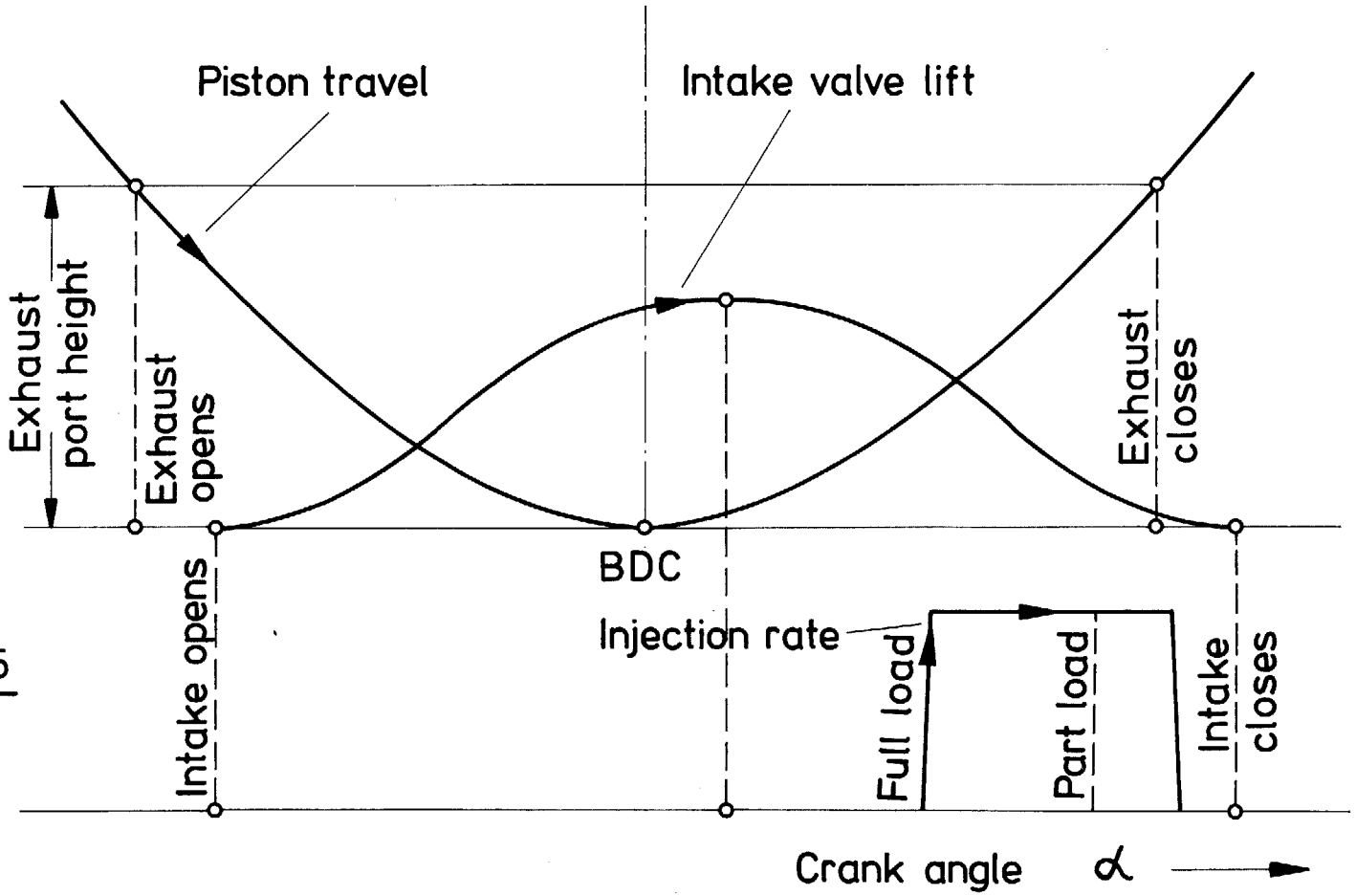
FIG. 5 is a graphic illustration of the relationship, according to the invention, between valve timing and injection rate and time for a two-cycle internal combustion engine.

For the two-cycle process according to the invention, FIG. 5 portrays the relative timing of fuel injection, intake vavle lift and exhaust port opening, plotted against the crank position. The intake valve is operated by a crankshaft-driven cam, while the exhaust ports are opened by the piston. Commencement of fuel injection into the intake duct varies, as shown, depending on the engine load, but it commences no sooner than the beginning of the second half of the scavenging period. Fuel induction terminates not later than the end of the scavenging period.

Due to the through-flow scavenging of the two-cycle engine, non-symmetrical timing of the intake valve and the exhaust ports may be used. As in FIGS. 6 and 6*a*, an intake valve 4*a* for pure scavenging air may also be added to reduce the throttling losses during the scavenging period. The other elements of FIGS. 6 and 6*a* are numbered with the same reference numerals and perform the same functions as the elements in FIGS. 4 and 4*a*.

The two-cycle engine with charge stratification according to the invention may be modified in the same way as the above-described four-cycle process, when only a moderate increase of the maximum excess air ratio over that achievable in the conventional spark ignition engine is intended. The extreme embodiment of this is illustrated in FIGS. 7 and 7*a* where the intake section 2 has been shifted from its initial lateral location (see FIGS. 6 and 6*a*) as far towards the cylinder axis as possible. Of course, various intermediate locations are possible depending upon the maximum excess air ratio desired.

Figure 6:
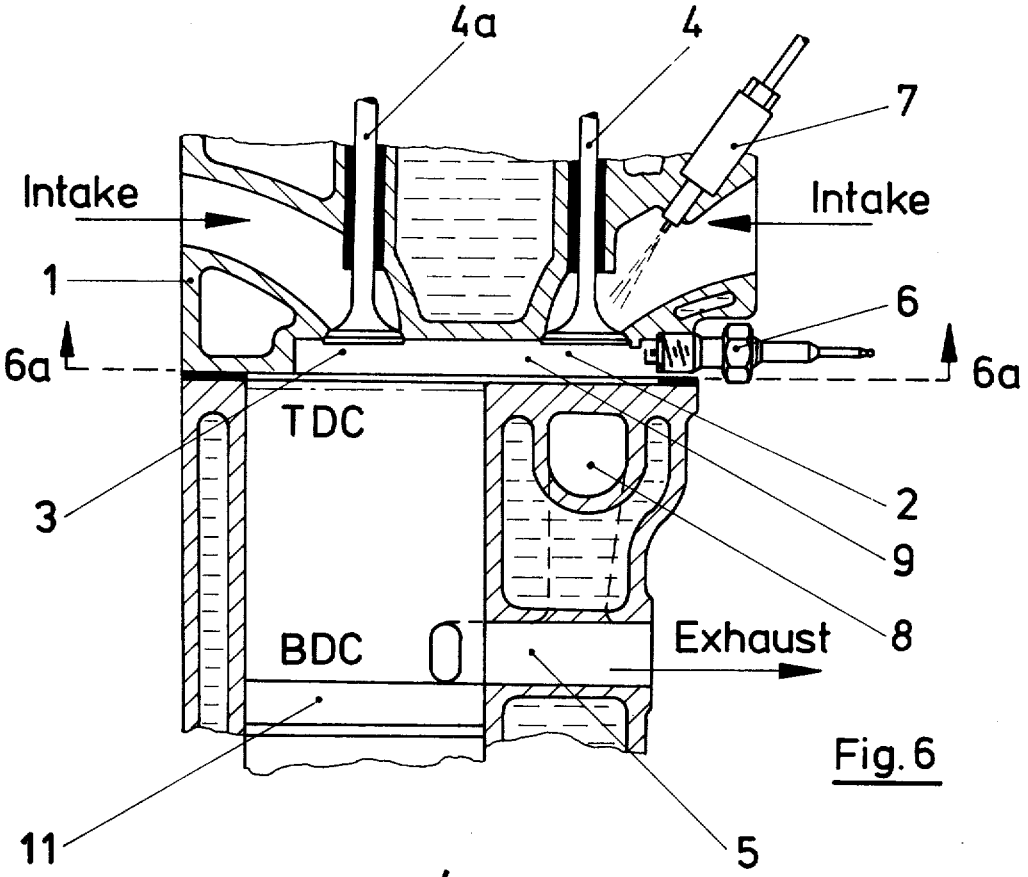
FIG. 6 is a sectional view of another embodiment of the invention.
Figure 6A:
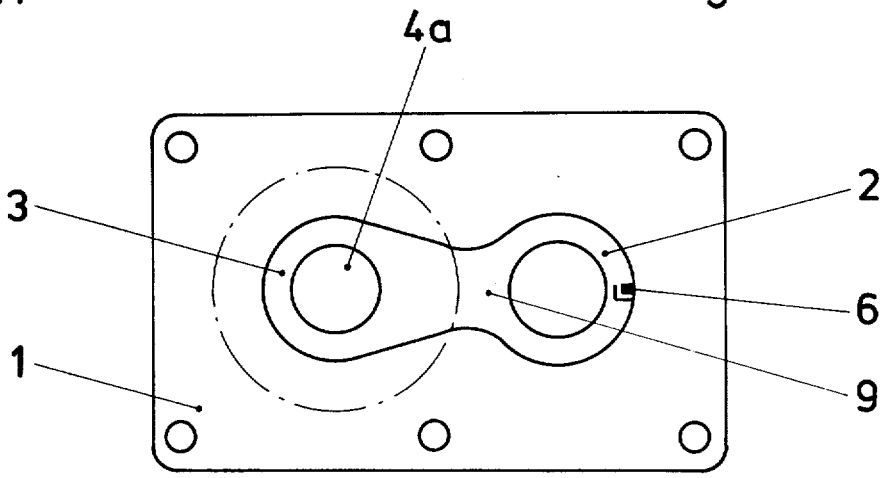
FIG. 6*a* is a diagrammatic bottom view of the embodiment of FIG. 6, taken along the line 6*a*—6*a*.
Figure 7:
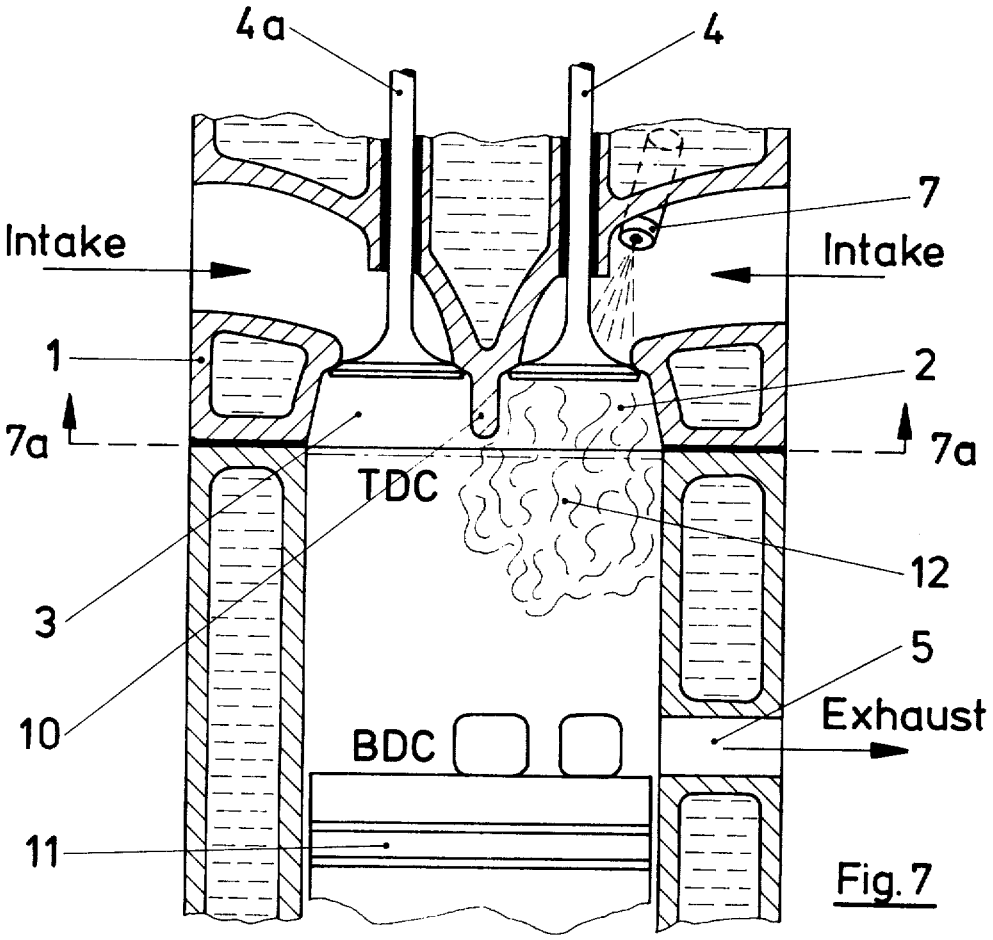
FIGS. 7 and 7*a* are generally similar to FIGS. 6 and 6*a*, but depicting yet another embodiment of the invention.
Figure 7A:
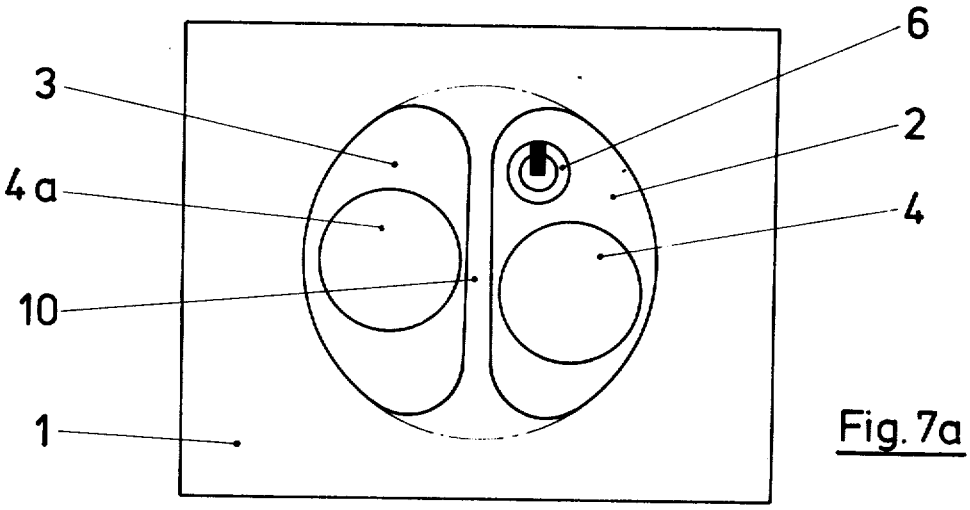

In FIGS. 7 and 7*a* the intake valves 4 and 4*a*, intake section 2, spark plug 6, exhaust section 3 of the combustion chamber and exhaust ports 5 perform the same function as the identically numbered elements in FIGS. 6 and 6*a*. The fuel induction is provided, as previously described for the basic two-cycle process (see FIG. 4), by the injector 7 and through intake valve 4, during the second half of the scavenging period. To further reduce the throttling losses during the scavenging period, a second intake valve 4*a* for the induction of pure scavenging air may be provided. This secondary intake valve is actuated simultaneously with the intake valve 4. The rich stratified fuel-air mixture is illustrated by cloud 12.

I claim:

1. In a reciprocating four-cycle internal combustion engine having a cylinder, a piston reciprocatingly received within the cylinder, a combustion chamber associated with the cylinder for the combustion of a fuel-air mixture, an intake manifold for the fuel-air mixture, an intake valve for introducing the fuel-air mixture from the intake manifold into the combustion chamber during the intake stroke of the piston, said intake valve being the sole means of introducing the fuel into the combustion chamber, and exhaust valve for discharging exhaust gases from the cylinder, and a spark plug for igniting the fuel-air mixture within the combustion chamber, the improvement comprising:

means for injecting the fuel at low pressure into the intake manifold immediately upstream of the intake valve, said low pressure fuel injecting means being operative to commence fuel flow to the intake manifold no sooner than commencement of the second half of the intake stroke of the piston and to terminate said fuel flow prior to or upon termination of the intake stroke;

means defining an intake section in the combustion chamber, the spark plug and the intake valve being located closely adjacent to one another and being encompassed by said intake section;

means defining an exhaust section in the combustion chamber spaced from the intake section, said exhaust valve being located in said exhaust section; and means defining a passage in the combustion chamber of restricted cross section relative to the cross section of the intake section coupling the intake section and the exhaust section, whereby upon induction of the fuel-air mixture into the intake section a stratified charge is established in the entire combustion chamber.

2. The engine of claim 1 wherein the intake section of the combustion chamber is spaced from the cylinder axis by a particular distance, said particular distance determining the maximum excess air-fuel ratio for the engine.

3. The engine of claim 1 wherein the intake section of the combustion chamber is located at least partly in overlying relation to the cylinder.

4. The engine of claim 1 wherein the intake section of the combustion chamber is located entirely in overlying relation to the cylinder.

5. The engine of claim 1 wherein the intake section of the combustion chamber is located outside of the projected cross section of the cylinder.

6. The engine of claim 1 wherein said restricted passage defining means comprises a transversely extending partition member located between the intake section and the exhaust section and protruding toward the piston, said partition member being of such a height that as the piston approaches top dead center, the piston crown and the partition member coact to form said restricted passage.

7. The engine of claim 1 wherein said restricted passage defining means comprises a transversely extending nose on the piston crown protruding towards the combustion chamber, said nose being of such a height that as the piston approaches top dead center, the nose enters the combustion chamber to form said restricted passage with the facing wall thereof.

8. In a reciprocating two-cycle internal combustion engine having a cylinder, a piston reciprocatingly received within the cylinder, a combustion chamber associated with the cylinder for the combustion of a fuel-air mixture, an intake manifold for the fuel-air mixture, an intake valve for introducing the fuel-air mixture from the intake manifold into the combustion chamber during the intake stroke of the piston, said intake valve being the sole means of introducing the fuel into the combustion chamber, an exhaust means for discharging exhaust gases from the cylinder, said exhaust means including an exhaust port that is opened by reciprocation of the piston in the scavenging period, and a spark plug for igniting the fuel-air mixture within the combustion chamber, the improvement comprising:

means for injecting the fuel at low pressure into the intake manifold immediately upstream of the intake valve, said low pressure fuel injecting means being operative to commence fuel flow to the intake manifold no sooner than commencement of the second half of the scavenging period and to terminate said fuel flow prior to or upon the termination of the scavenging period;

means defining an intake section in the combustion chamber, the spark plug and the intake valve being located closely adjacent to one another and being encompassed by said intake section;

means defining an exhaust section in the combustion chamber spaced from the intake section; and means defining a passage in the combustion chamber of restricted cross section relative to the cross section of the intake section coupling the intake section and the exhaust section, whereby upon induction of the fuel-air mixture into the intake section a stratified charge is established in the entire combustion chamber.

9. The engine of claim 8 wherein the intake section of the combustion chamber is located at least partly in overlying relation to the cylinder.

10. The engine of claim 8 wherein the intake section of the combustion chamber is located entirely in overlying relation to the cylinder.

11. The engine of claim 8 wherein the intake section of the combustion chamber is located outside of the projected cross section of the cylinder.

12. The engine of claim 8 wherein said restricted passage defining means comprises a transversely extending partition member located between the intake section and the exhaust section and protruding toward the piston, said partition member being of such a height that as the piston approaches top dead center, the piston crown and the partition member coact to form said restricted passage.

13. The engine of claim 8 wherein said restricted passage defining means comprises a transversely extending nose on the piston crown protruding towards the combustion chamber, said nose being of such height that as the piston approaches top dead center, the nose enters the combustion chamber to form said restricted passage with the facing wall thereof.

14. The engine of claim 8 wherein the intake section of the combustion chamber is spaced from the cylinder axis by a particular distance, said particular distance determining the maximum excess air-fuel ratio for the engine.

* * * * *